US007381161B2

(12) United States Patent
Ellis

(10) Patent No.: US 7,381,161 B2
(45) Date of Patent: Jun. 3, 2008

(54) EXERCISE TREADMILL FOR PULLING AND DRAGGING ACTION

(75) Inventor: Joseph K. Ellis, Ocala, FL (US)

(73) Assignee: Fitness Tools, LLC, Ocala, FL (US)

( * ) Notice: Subject to any disclaimer, the term of this patent is extended or adjusted under 35 U.S.C. 154(b) by 0 days.

(21) Appl. No.: 11/289,916

(22) Filed: Nov. 30, 2005

(65) Prior Publication Data

US 2007/0123395 A1 May 31, 2007

(51) Int. Cl.
*A63B 71/00* (2006.01)
*A63B 21/00* (2006.01)

(52) U.S. Cl. ..... 482/54; 482/51

(58) Field of Classification Search ..... 482/1–9, 482/51–54, 66–71, 900–902; 434/247; 119/700
See application file for complete search history.

(56) References Cited

U.S. PATENT DOCUMENTS 5,226,866 A * 7/1993 Engel et al. ..... 482/70
5,318,491 A * 6/1994 Houston ..... 482/54
5,595,556 A * 1/1997 Dalebout et al. ..... 482/54
5,951,449 A 9/1999 Oppriecht
6,764,429 B1 7/2004 Michalow
6,811,517 B1 * 11/2004 Eschenbach ..... 482/52
6,837,830 B2 * 1/2005 Eldridge ..... 482/54
6,893,382 B1 5/2005 Moon et al.

* cited by examiner

*Primary Examiner*—Glenn Richman
(74) *Attorney, Agent, or Firm*—Laurence P. Colton; Smith, Gambrell & Russell

(57) ABSTRACT

An exercise treadmill of the type having an endless moveable surface looped around rollers or pulleys to form an upper run and a lower run, the movable surface being rotated when one of the rollers or pulleys is rotated, an exercise surface on for walking or running while exercising, and a weight resistance means for simulating the dragging or pulling of a load, wherein the endless movable surface moves in a direction simulating walking or running backwards.

24 Claims, 11 Drawing Sheets

EXERCISE TREADMILL FOR PULLING AND DRAGGING ACTION

BACKGROUND OF THE INVENTION

1. Technical Field

This invention relates to the general technical field of exercise, physical fitness and physical therapy equipment and machines and to the more specific novel technical field of a mechanically, electrically and electronically operated reverse treadmill machine designed to simulate a dragging or pulling motion when operated by the user.

2. Prior Art

Exercise, physical fitness and physical therapy equipment and machines are available in various configurations and for various purposes, and are available for all of the major muscle groups. The majority of such equipment and machines, especially in the exercise field, concentrate either on an aerobic or anaerobic workout or on areas of the body such as the legs, the hips and lower torso, the chest and upper torso, the back, the shoulders and the arms.

Exercise treadmills are well known and are used for various purposes, including for walking or running aerobic-type exercises, and diagnostic and therapeutic purposes. For the known and common purposes, the person on the exercise treadmill normally can perform an exercise routine at a relatively steady and continuous level of physical activity or at a variable level of physical exercise including varying both the speed and incline of the treadmill during a single session.

Exercise treadmills typically have an endless running surface extending between and movable around rollers or pulleys at each end of the treadmill. The running surface generally is a relatively thin rubber-like material driven by a motor rotating one of the rollers or pulleys. The speed of the motor is adjustable by the user or by a computer program so that the level of exercise can be adjusted to simulate running or walking.

The belt typically is supported along its upper length between the rollers or pulleys by one of several well known designs in order to support the weight of the user. The most common approach is a deck or support surface beneath the belt, such as a plastic or metal panel, to provide the required support. A low-friction sheet or laminate, such as TEFLON® brand of synthetic resinous fluorine-containing polymers, can be provided on the deck surface (or indeed can be the material of construction of the deck surface) to reduce the friction between the deck surface and the belt.

Many current exercise treadmills, especially the middle to upper level of exercise treadmills, also have the ability to provide a variable incline to the treadmill. The incline is accomplished in one of two manners—either the entire apparatus is inclined or just the walking and running surface is inclined. Further, the inclination can be accomplished by either manual or power driven inclination systems, and can be accomplished either at the command of the user or as part of a computerized exercise regimen programmed into the exercise treadmill. An inclination takes advantage of the fact that the exercise effort, or aerobic effect, can be varied with changes in inclination, requiring more exertion on the part of the user when the inclination is greater.

To the best of this inventor's knowledge, known exercise treadmills are structured to allow the user to walk or run in a forward direction, with the belt traveling in a direction that simulates walking or running forward; that is, the belt runs across the top of the deck in a front to back motion. Additionally, to the best of this inventor's knowledge, the inclination mechanisms in known exercise treadmills are structured to allow the user to walk or run in a level or uphill inclination; that is, the front of the deck can be level with the back of the deck or can be raised relative to the back of the deck to simulate an uphill inclination. Further, to the best of the inventor's knowledge, the hand rails and hand controls in known exercise treadmills are structured to complement simulated forward motion.

However, the inventor is unaware of any specific exercise treadmill that is structured to allow the user to comfortably simulate a dragging or pulling motion; that is, a backwards walking motion either on a level plane or uphill. Additionally, the inventor is unaware of any specific exercise treadmill that has an adjustable weight resistance against dragging or pulling so as to simulate dragging or pulling of a load. A simulated dragging or pulling motion can be useful for exercising and developing different groupings of muscles and for providing an aerobic workout. Thus it can be seen that an exercise treadmill simulating a dragging or pulling motion would be useful, novel and not obvious, and a significant improvement over the prior art. It is to such an exercise treadmill that the current invention is directed.

BRIEF SUMMARY OF THE INVENTION

The present invention is an exercise treadmill for simulating the dragging or pulling of an object on a level surface, up an incline or down a decline. The treadmill has a lower base housing the internal mechanical components, a pivot arm on which a hand controller is mounted, and a weight resistance means located within the lower base. The weight resistance means is operatively connected to the pivot arm via a cable. In operation, when a user steps onto the treadmill and grips the hand controller and starts belt moving, the user begins to walk or run in a simulated backwards direction relative to the hand controller, causing the user to pull on the hand controller. This pulling transfers to the pivot arm, as the hand controller is attached to the pivot arm, thus pulling on the cable, which in turn pulls on the weight resistance means. Alternatively, the treadmill may be set up to begin to move automatically at a speed and at an inclination according to a value entered from the hand controller.

The degree of weight resistance of the weight resistance means can be controlled by the user to simulate dragging or pulling a weight such that the exercise regimen is similar to walking or running backwards while dragging or pulling an object of a weight comparable to the setting of the weight resistance means. The higher the setting of the weight resistance means, the heavier the simulated object being pulled. In preferred embodiments, the weight resistance means can be an adjustable spring or hydraulic or pneumatic cylinder, a spring with a known spring constant or a hydraulic or pneumatic cylinder with a known resistance, a flexible rod with a known elastic modulus, or a frictional coupling with known coefficients of friction.

Generally speaking, the internal mechanic components of the treadmill are similar to (or can be similar to or the same as) the internal mechanical components of known treadmills. The treadmill comprises an endless belt looped about rollers or pulleys so as to provide a platform on which the user can stand, walk and/or run. A deck below a portion of the belt supports the belt and the user. A belt motor cooperates with the belt and/or the rollers or pulleys to move the belt, thus creating a moving platform on which the user can walk or run for the exercise regimen. An incline motor cooperates with the platform, the deck, the rollers or pulleys or rear legs to incline the belt to simulate a hill.

These objects, and other objects, features and advantages of the present invention will become more apparent to those of ordinary skill in the art when the following detailed description of the preferred embodiments is read in conjunction with the appended figures.

DETAILED DESCRIPTION OF THE PREFERRED EMBODIMENTS

Figure 1:
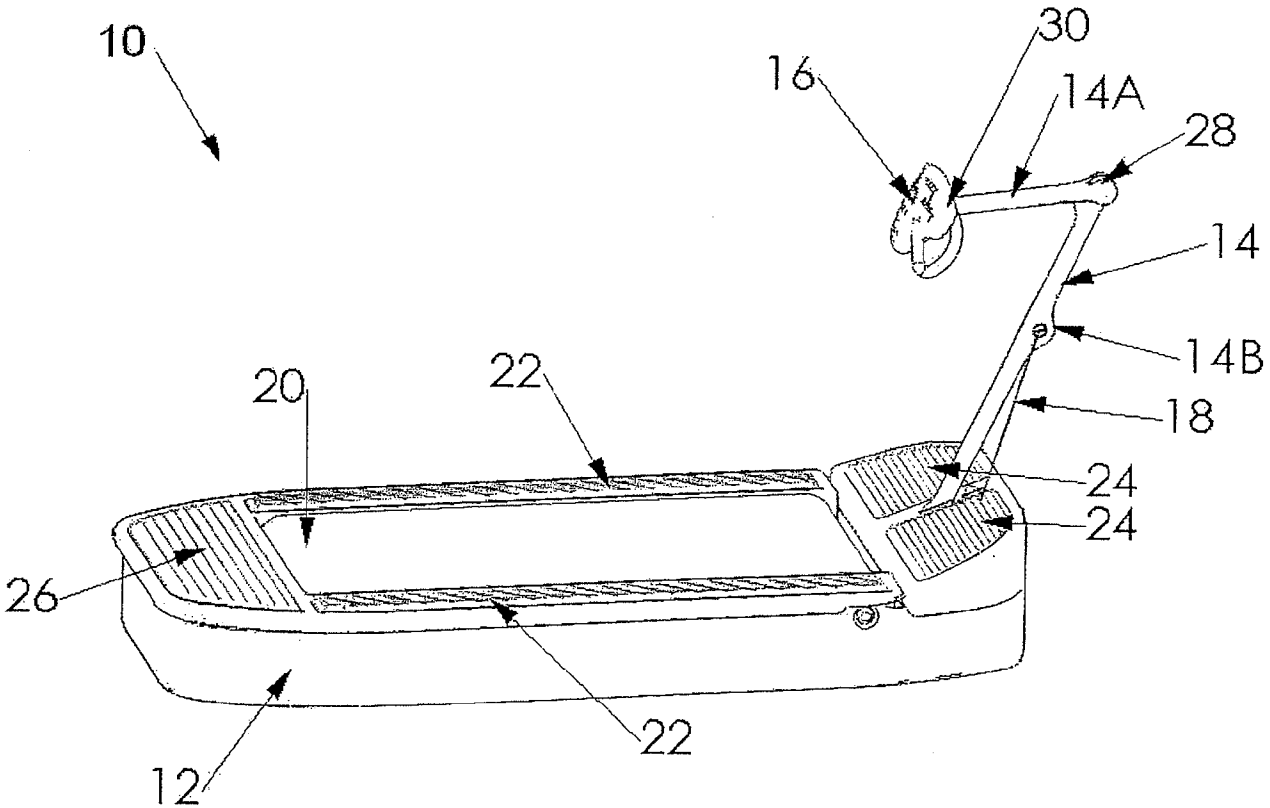
FIG. 1 is a perspective view of the invention.
Figure 2:
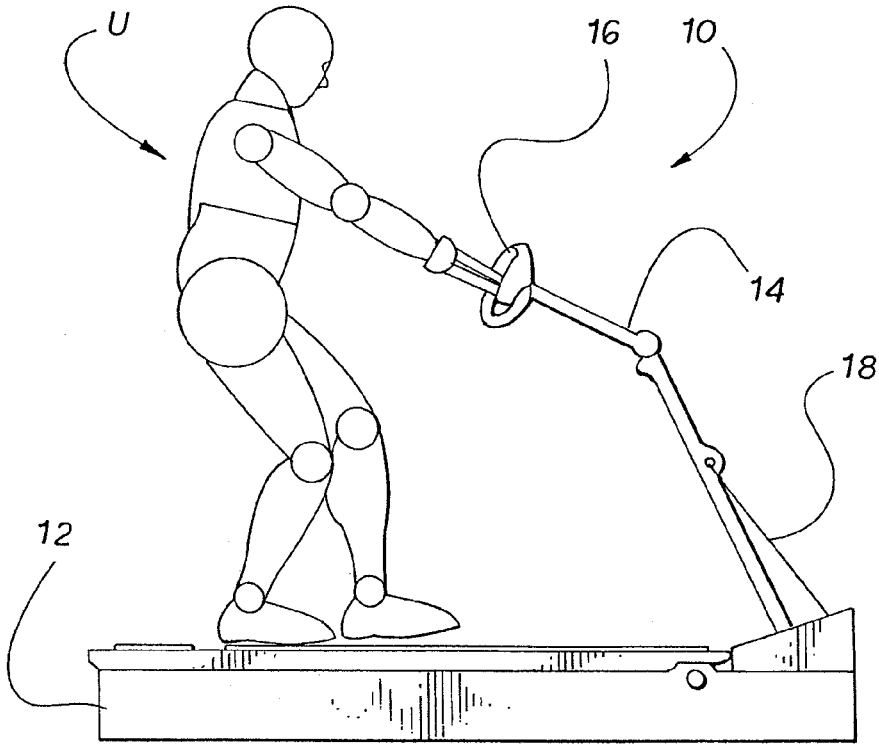
FIG. 2 is a side view of the in invention operating in a flat position.
Figure 3:
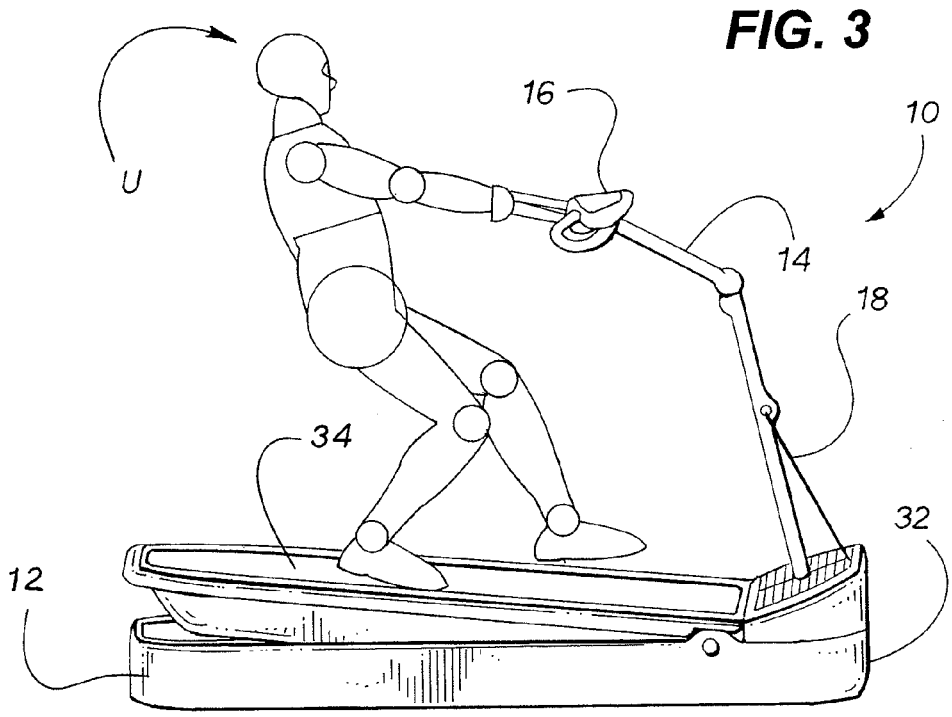
FIG. 3 is a side view of the invention operating in an inclined position.
Figure 4:
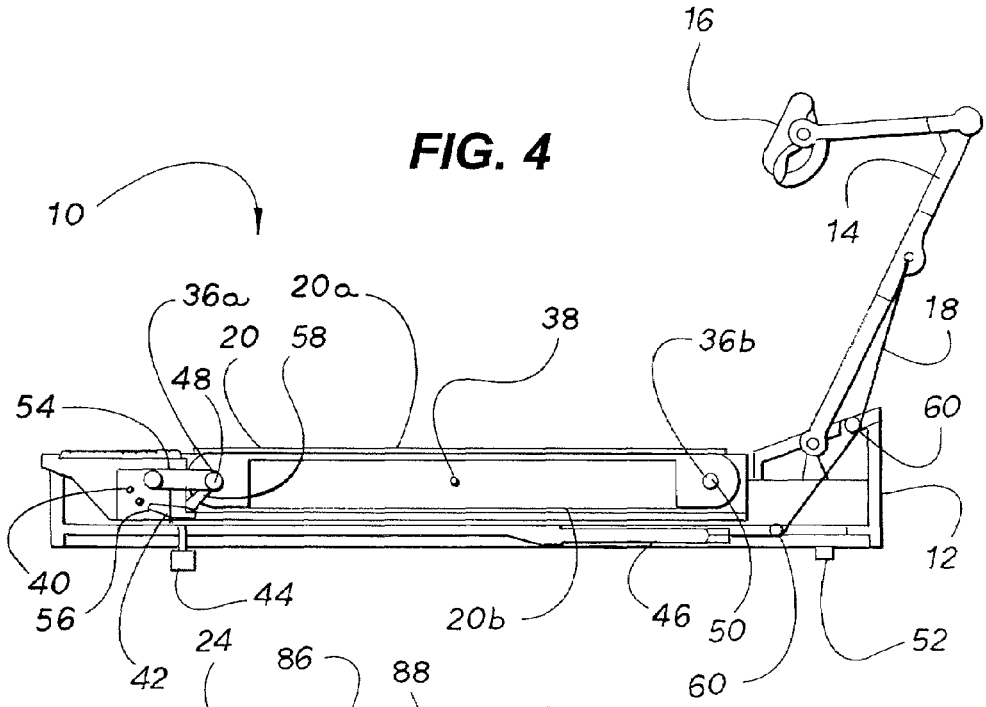
FIG. 4 is a side sectional view of the invention showing the internal mechanical components.

Referring now to the appended figures, the invention will be described in connection with representative preferred embodiments. FIG. 1 is a perspective view of the invention illustrating the relationship between the various major components of the device. FIG. 2 is a side view of the invention showing a user operating the invention in a flat or level dragging or pulling simulation. FIG. 3 is a side view of the invention showing a user operating the invention in an inclined dragging or pulling simulation. FIG. 4 is a side sectional view of the invention showing a schematic of the internal mechanical components of the invention.

Figure 4A:
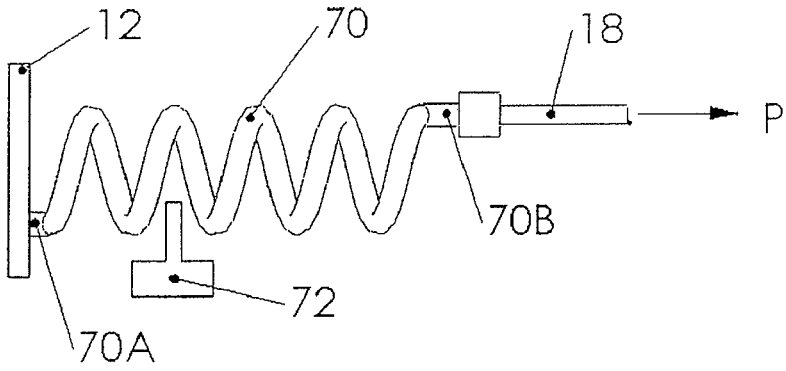
FIG. 4A is a side schematic of a tension spring-based weight resistance means suitable for the invention.
Figure 4B:
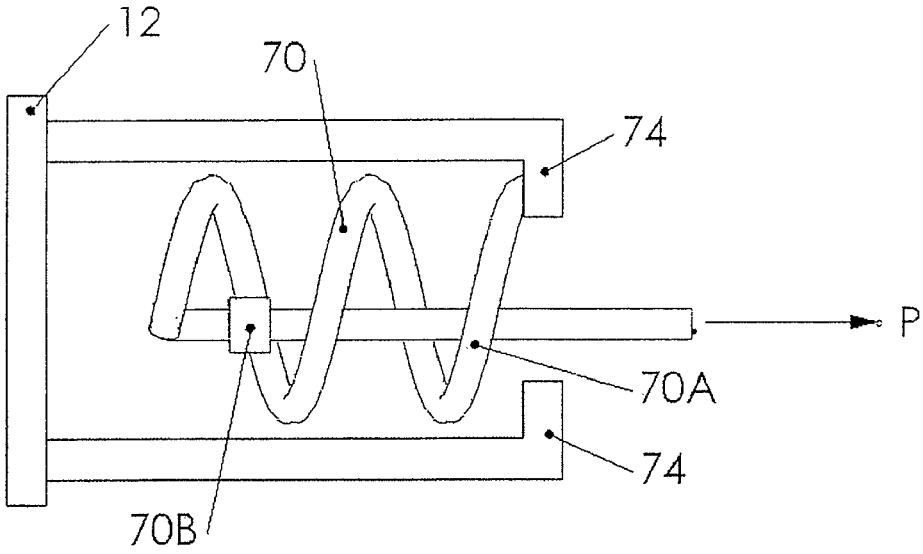
FIG. 4B is a side schematic of a compression spring-based weight resistance means suitable for the invention.
Figure 4C:
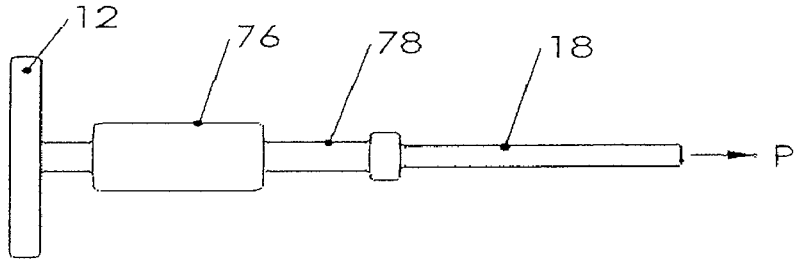
FIG. 4C is a side schematic of a first hydraulic or pneumatic cylinder-based weight resistance means suitable for the present invention.
Figure 4D:
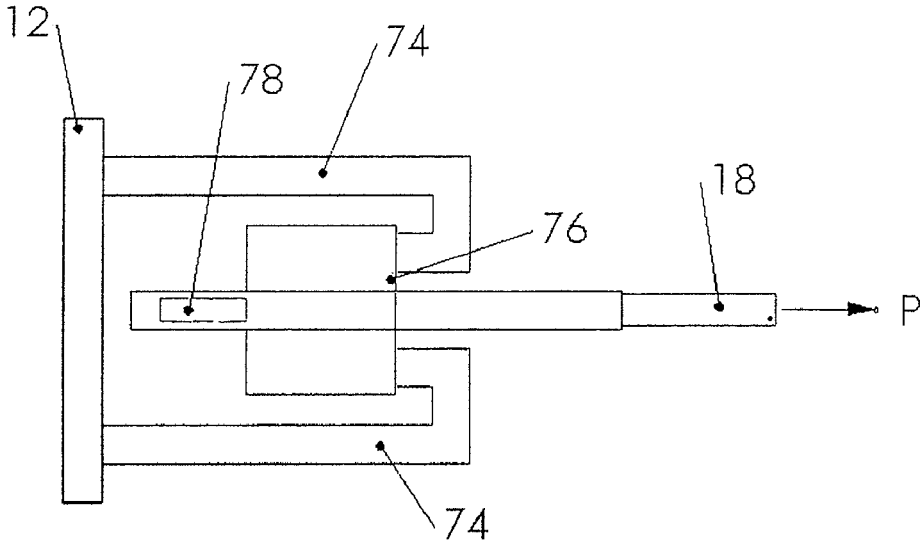
FIG. 4D is a side schematic of a second hydraulic or pneumatic cylinder-based weight resistance means suitable for the present invention.
Figure 4E:
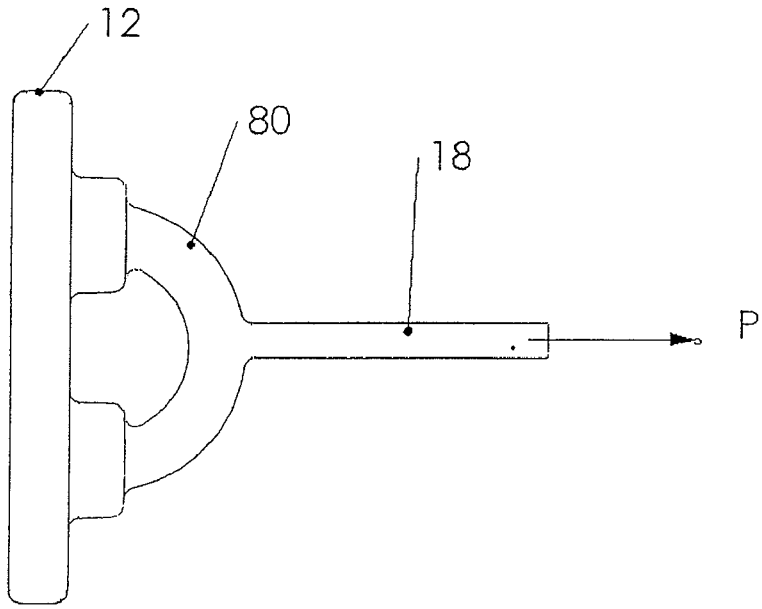
FIG. 4E is a top schematic of a flexible rod-based weight resistance means suitable for the present invention.
Figure 4F:
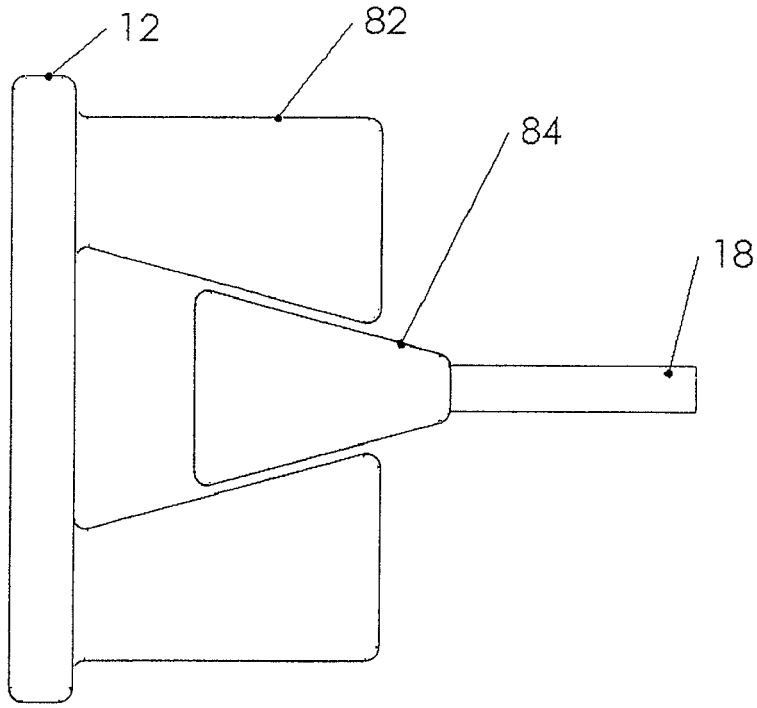
FIG. 4F is a top schematic of a frictional coupling-based weight resistance means suitable for the present invention.

FIGS. 4A through 4F show several illustrative weight resistance means suitable for use with the invention. FIG. 4A is a side schematic of a spring-based weight resistance means suitable for the invention, such as a spring with a known spring constant in tension. FIG. 4B is a side schematic of a compression spring-based weight resistance means suitable for the invention, such as a spring with a known spring constant in compression. FIG. 4C is a side schematic of a first hydraulic cylinder-based weight resistance means suitable for the present invention, such as a hydraulic cylinder with known or adjustable resistance, in which the resistance is created by pulling the piston rod out of the hydraulic cylinder. FIG. 4D is a side schematic of a second hydraulic cylinder-based weight resistance means suitable for the present invention, such as a hydraulic cylinder with known or adjustable resistance, in which the resistance is created by pushing the piston rod into the hydraulic cylinder. FIG. 4E is a top schematic of a flexible rod-based weight resistance means suitable for the present invention, such as a rod with a known elastic modulus. FIG. 4F is a top schematic of a frictional coupling-based weight resistance means suitable for the present invention, such as a combination of elements having known coefficients of friction.

Figure 5:
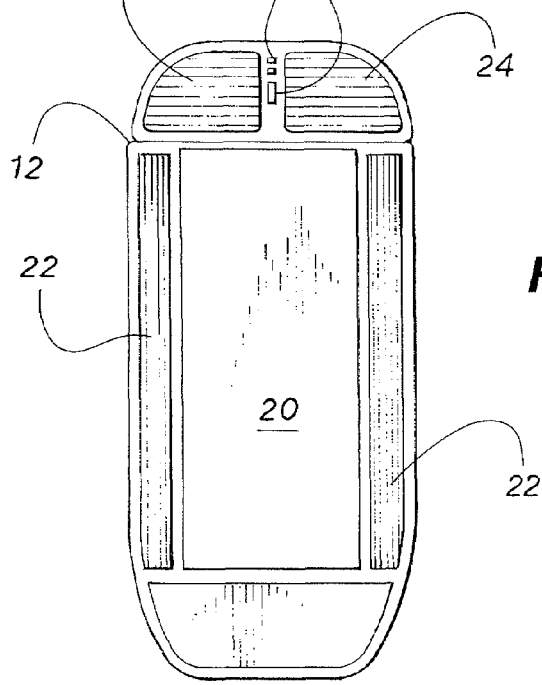
FIG. 5 is a top view of the base of the invention.
Figure 6:
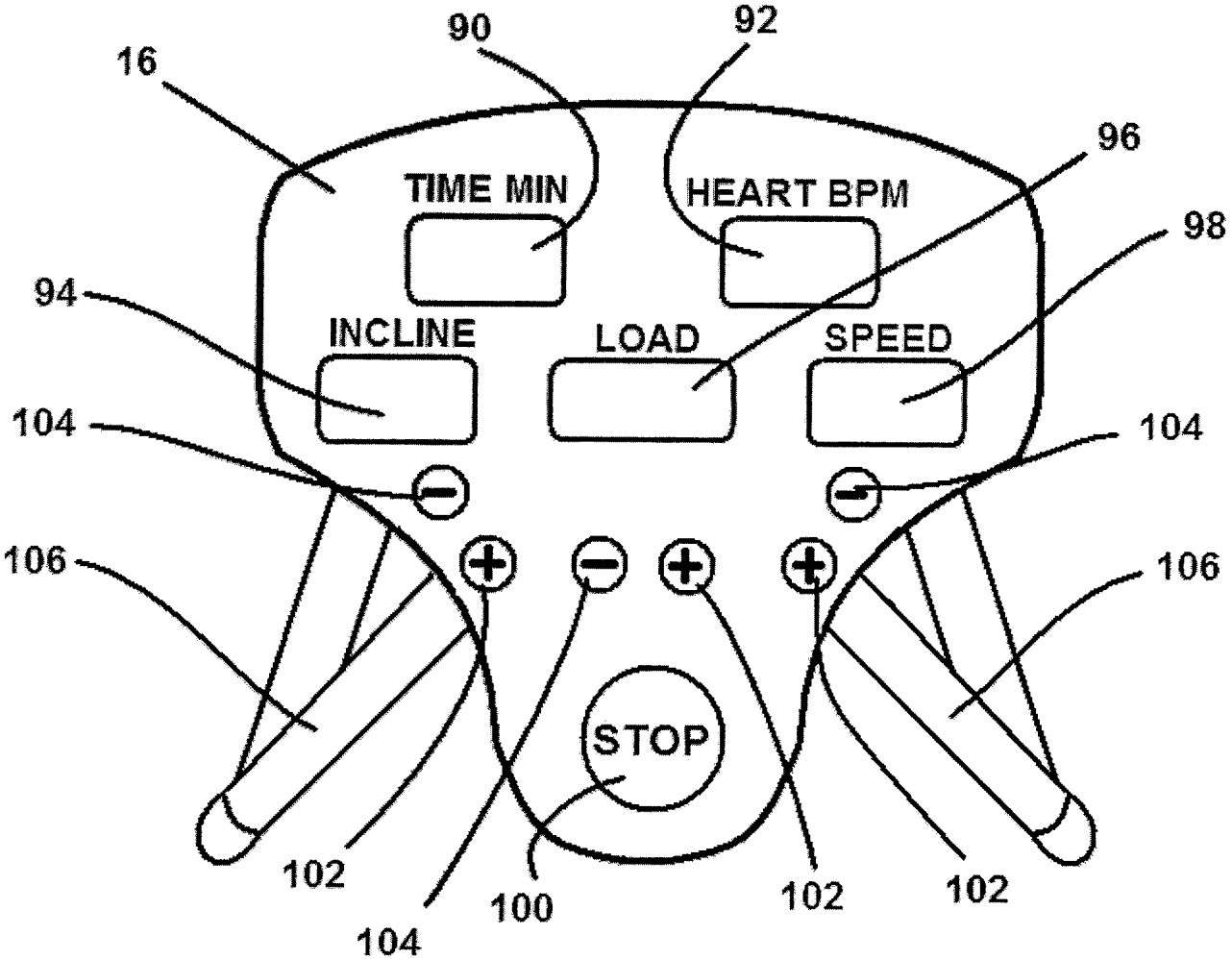
FIG. 6 is a top view of a representative hand control for the invention.
Figure 7:
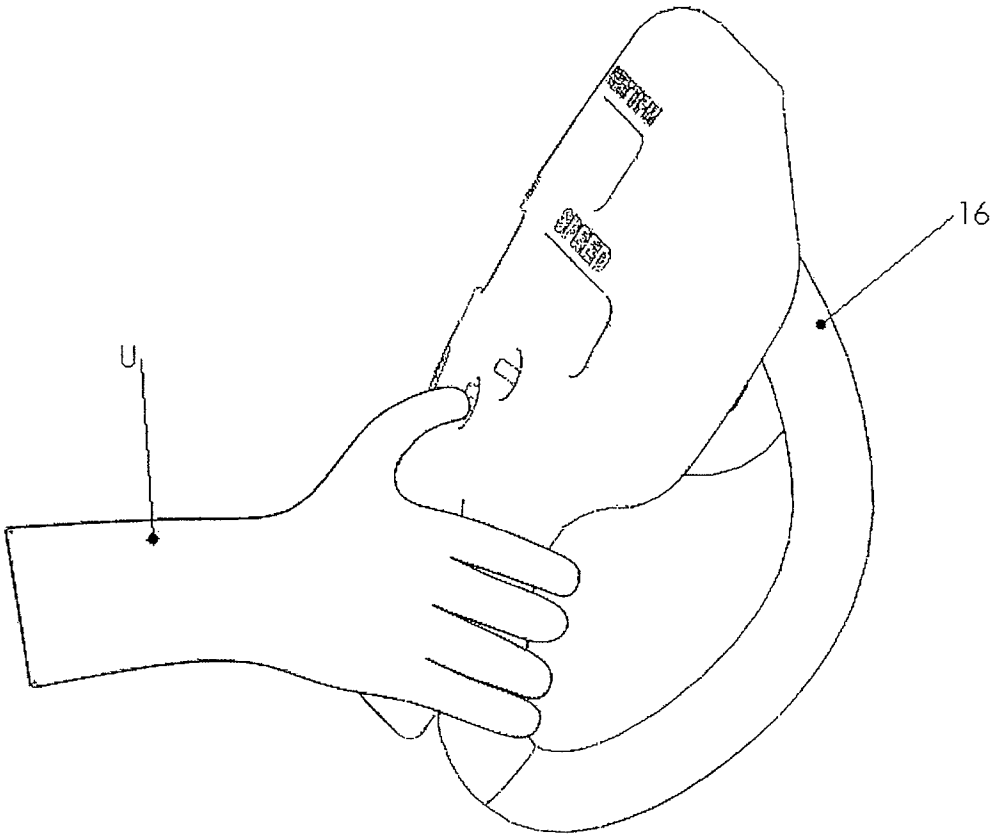
FIG. 7 is a side view of the representative hand control for the invention shown in FIG. 6.
Figure 8:
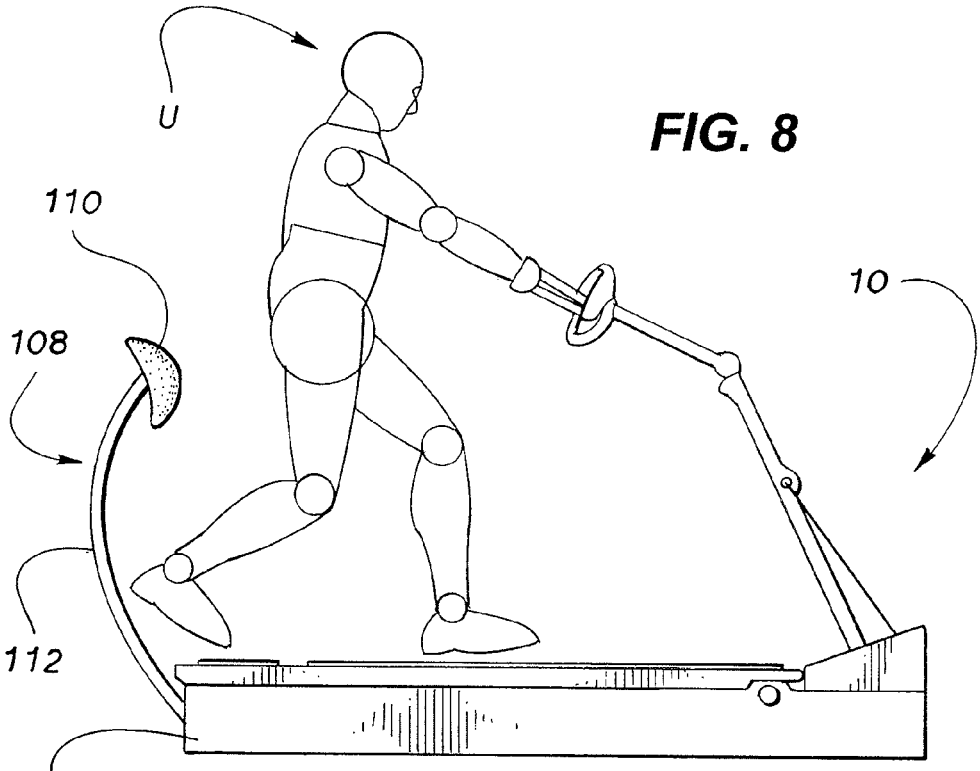
FIG. 8 is a side view of the invention with an optional rear safety arm.
Figure 9:
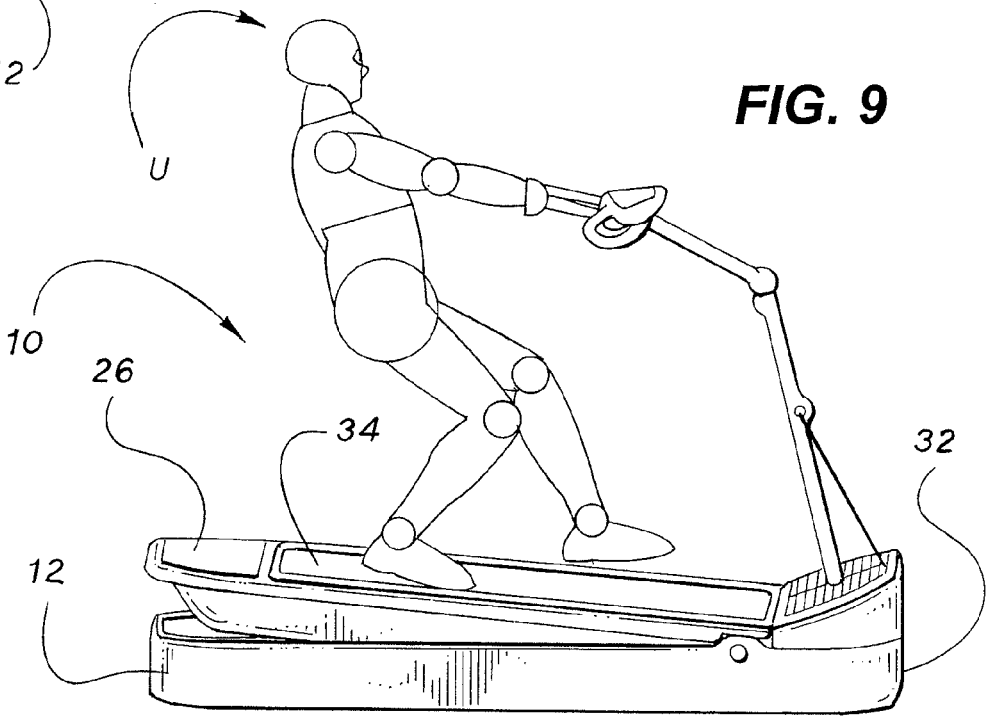
FIG. 9 is a side view of the invention with an optional rear step-off platform.
Figure 10:
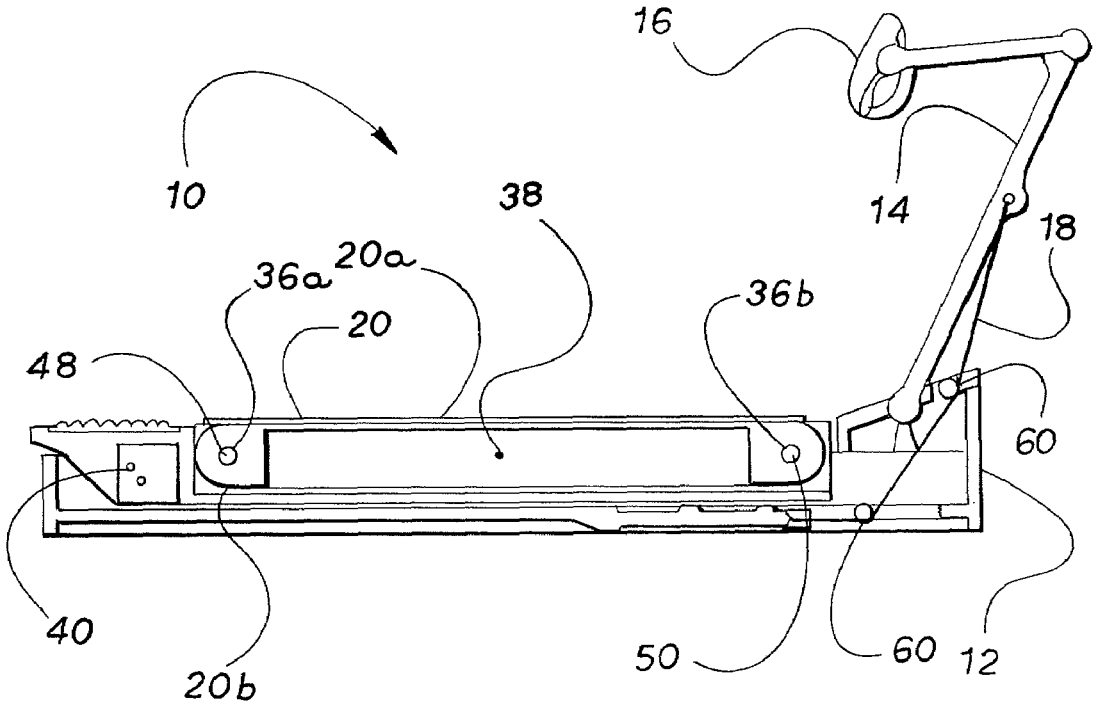
FIG. 10 is a side sectional view of the invention with an optional rear step-off platform showing an alternate configuration of the internal mechanical components.

FIG. 5 is a top view of the base of the invention illustrating the relative positioning of various components of the invention. FIG. 6 is a top view of a representative hand control for the invention showing various features that can be included on the hand control. FIG. 7 is a side view of the representative hand control for the invention shown in FIG. 6. FIG. 8 is a side view of the invention with an optional rear safety arm to help prevent the user from inadvertently stepping off the rear of the invention. FIG. 9 is a side view of the invention with an optional rear step-off platform on which the user can step if exiting the invention from the rear. FIG. 10 is a side sectional view of the invention with an optional rear step-off platform showing an alternate configuration of the internal mechanical components illustrating the relationship between the various major components of the device.

FIG. 1 is a perspective view of the invention illustrating the relationship between the various major components of the device. Treadmill 10 has a lower base 12 housing the internal mechanical components of treadmill 10. Projecting upwardly from base 12 is pivot arm 14 on which hand controller 16 is mounted. Pivot arm 14 can comprise one, two, more pivot arm sections. As illustrated in FIG. 1, pivot arm 14 comprises two pivot arm sections, upper pivot arm 14A and lower pivot arm 14B, such that pivot arm 14 is self-aligning for users U of different heights and body builds. Additionally, the use of a two-part pivot arm 14, or a multi-part pivot arm 14, provides for a more biometrically acceptable pulling motion and to position pivot arm 14 as far away from user U (shown in FIGS. 2, 3, 8 and 9) as possible to avoid incidental and unwanted contact with pivot arm 14. Further, the use of a two-part pivot arm 14, or a multi-part pivot arm 14, can be more comfortable to user U. First mounting means 28 pivotally attaches upper pivot arm 14A to lower pivot arm 14B.

Hand controller 16 is mounted on the end of upper pivot arm 14A distal from lower pivot arm 14B, which also is proximal to user U when user U is in the correct position for operating the treadmill 10. Second mounting means 30 attaches hand controller 16 to upper pivot arm 14A and can be a static or motionless connection, with hand controller 16 rigidly connected to upper pivot arm 14A, or a dynamic or moving connection, with hand controller 16 movably connected to upper pivot arm 14A, such as in a two-dimensional pivoting or three-dimensional joystick configuration. The combination of pivot arm 14 and hand controller 16 provides user U with a means of support either during the entire exercise period or for an initial period until user U has assimilated himself or herself to the speed of the treadmill. The combination of first mounting means 28 and second mounting means 30 allows desired motion of pivot arm 14 and hand controller 16 relative to user U.

Alternatively, there can be two pivot arms 14, one for each hand of user U. If two pivot arms 14 are used, the controls on hand controller 16 can be on one or the other of pivot arms 14, or split between the two pivot arms 14. Further, the use of two independent pivot arms 14 can simulate the arm-swinging motion that normally occurs during walking or running, which may be advantageous to user U.

Hand controller 16 can include electronic controls and information displays that typically are provided on exercise treadmills for purposes such as adjusting the speed and incline of treadmill 10, the time user U has been operating treadmill 10 and/or the time left in a set exercise regimen, user's U heart rate, the simulated load being dragged or pulled, on and off buttons, and an emergency off button, and other functions, as will be discussed later in connection with FIGS. 6 and 7. Various step off platforms, such as side step offs 22, front step offs 24 and rear step-offs 26, can be included in various configurations both to allow user U easy access to the treadmill 10 and to provide safety platforms for user U to step off treadmill 10 onto a non-moving platform, as will be discussed later in connection with FIG. 5. Attached to lower pivot arm 14B and extending between lower pivot arm 14B and a weight resistance means 46 shown in more detail in FIG. 4 is weight resistance cable 18.

In normal operation, user U will step onto belt 20 and grasp hand controller 16, positioning himself or herself generally centrally on belt 20 so as to face the hand controller 16. As belt 20 begins to move, as will be discussed later, user U will start a rearward walking or running motion towards the rear of treadmill 10, with belt 20 moving accordingly, such that user U will remain generally in the same position centrally on belt 20 as treadmill 10 is operating. Alternatively, treadmill 10 may be set up to begin to move automatically at a speed according to a value entered from hand controller 16. The pace of the walking or running motion may be increased or decreased depending upon the speed of belt 20. The speed of belt 20 can be controlled by the adjustment of the controls on hand controller 16, along with the adjustment of the inclination of treadmill 10 and other functions and features, as will be discussed later in connection with FIGS. 6 and 7. Belt 20 also can comprise two belts, one for each foot, as an alternative.

FIG. 2 is a side view of the invention showing user U operating the treadmill 10 in a flat or level dragging or pulling simulation. In this position, user U is simulating a level surface dragging or pulling motion and is walking or running backwards and pulling on hand controller 16, and thus pulling against weight resistance means 46. FIG. 3 is a side view of the invention showing user U operating the treadmill 10 in an inclined dragging or pulling simulation. In this position, user U is simulating an inclined uphill dragging or pulling motion and is walking or running backwards and uphill and pulling on hand controller 16, thus simultaneously pulling against weight resistance means 46 and moving uphill. As will be discussed later in connection with FIG. 4, hand controller 16 and pivot arm 14 via first mounting means 28 and second mounting means 30 allow the appropriate motion of pivot arm 14 hand controller 16 relative to user U for self-alignment and for proper and comfortable operation of treadmill 10.

The use of one or more pivot points such as first mounting means 28 and second mounting means 30 allows the various sections of pivot arm 14 to pivot relative to each other and to user U, resulting in a self-aligning feature. Further, as pivot arm 14 is pivotally attached to base 12, there is another degree of movement for event greater alignment of pivot arm 14 relative to user U. For example, as user U grasps hand controller 18, user U can move hand controller 18 upwards and downwards, and towards or away from user U, so as to place hand controller 18 in a position most comfortable to user U. Further, as the pivot points are freely pivotable, hand controller 18 in effect self-aligns to an appropriate position relative to user U simply upon being grasped by user U. The addition of additional pivot points, such as by making pivot arm 14 multi-sectional, can enhance this self-aligning feature.

As can be seen in FIG. 3, base 12 can comprise a separate support platform 32 and belt platform 34. In such a configuration, the main support for treadmill 10 along with belt motor 40 (shown in FIG. 4), incline motor 42 (shown in FIG. 4) and weight resistance means 46 (shown in FIG. 4) preferably are located in support platform 32, whereas belt 20 and belt movement means (disclosed in connection with and shown in FIG. 4) preferably are located in belt platform 34. Alternatively, each of the above disclosed elements can be located as desired in either support platform 32 or belt platform 34 by the engineer of ordinary skill in the art. In such a configuration, the inclination of belt 20 is accomplished by incline motor 42 raising belt platform 34 relative to support platform 32, in a manner well known in the art.

Alternatively, base 12 can comprise a single platform. In such a configuration, all of the above disclosed elements, namely the main support for treadmill 10, belt motor 40 (shown in FIG. 4), incline motor 42 (shown in FIG. 4) and weight resistance means 46 (shown in FIG. 4), are located in base 12. In such a configuration, the inclination of belt 20 is accomplished by incline motor 42 raising the rear end of base 12 relative to the front end of base 12, in a manner well known in the art.

FIG. 4 is a side sectional view of the invention showing a schematic of the internal mechanical components of the treadmill 10. Generally speaking, because the internal mechanic components of the treadmill 10 are similar to (or can be similar to or the same as) the internal mechanical components of known treadmills, the internal mechanical components will be discussed in general terms. Treadmill 10 comprises an endless belt 20 looped about rollers or pulleys 36. Rollers or pulleys 36 are rotatably secured within base 12 such that belt 20 can continuously travel about rollers or pulleys 36. Located between rollers or pulleys 36 and within the endless loop of belt 20 is deck 38 for supporting the top run 20A of belt 20. Specifically, as when user U steps on belt 20, belt 20 is pressed against deck 38 to support user U. Belt motor 40 cooperates with belt 20 and/or rollers or pulleys 36 to move belt 20. Incline motor 42 cooperates with belt platform 34, deck 38, rollers or pulleys 36 or rear legs 44 to incline belt 20. Weight resistance means 46 cooperates with pivot arm 14 via cable 18. Cable 18 can be of any structure, such as a rope, a chain, a belt, monofilaments, braided wires, and other suitable equivalents, that allow a transfer of force between pivot arm 14 and weight resistance means 46, and is not limited to a standard cable.

A representative drive assembly for belt 20 is schematically illustrated in FIG. 4. Front roller or pulley 36A is rotatably mounted within base 12, such as on axle 48. Rear roller or pulley 36B is rotatably mounted within base 12, such as on axle 50. Axles 48, 50 typically are secured to a frame portion of base. Front roller or pulley 36A and rear roller or pulley 36B are positioned substantially parallel to each other. Belt 20 is looped around rollers or pulleys 36 so as to allow belt 20 to move continuously about rollers or pulleys 36, thus forming upper run 20A and lower run 20B. User U steps on belt 20 during normal operation of treadmill 10, causing belt 20 to bend under the weight of user U. Belt 20 is supported for a portion of its length, and for a substantial portion of upper run 20A, between rollers or pulleys 36 by deck 38. To reduce friction between the underside of upper run 20A and the top surface of deck 38, a low friction material can be applied to the top surface of deck 38 or the underside of belt 20, or both. Alternatively, deck 38 can be constructed of a low friction material. Deck 38 preferably is rigidly secured within base 12 or belt platform 34. This configuration is known in the treadmill art.

In the illustrative example shown in FIG. 4, rear roller or pulley 36B is rotated by belt motor 40, such as by fan belt 54 or by a direct drive (not shown), during normal operation of treadmill 10. Belt motor 40 is mounted within base 12. Rear roller or pulley 36A is rotated by belt motor 40. As discussed in more detail later, the speed at which rear roller or pulley 36A is rotated can be controlled by a microprocessor (not shown) through belt motor 40. The speed is adjustable from controls on hand controller 16. With this arrangement, it is therefore possible to vary the speed of belt 20 during the exercise regimen. This configuration is known in the treadmill art.

In the illustrative example shown in FIG. 4, an inclination mechanism is provided to permit inclination of deck 38. Specifically, FIG. 4 illustrates three different and separate inclination mechanisms. Preferably, only one inclination mechanism is used, but three are shown as alternatives to each other. If desired, two or more inclination mechanisms can be used in the same machine, with each being used independently from or in conjunction with each other. The three different lift mechanisms are a leg lift, comprising incline motor 42 and rear legs 44, and two different belt platform 34 lifts, comprising lift motor 42 and a means for lifting belt platform 34. Each of these three lift mechanisms are known in the treadmill art.

In the leg lift, incline motor 42 is connected to rear legs 44. Actuation of incline motor 42 causes the lifting of the entire base 12 relative to rear legs 44. This causes treadmill 10 to pivot upwards about front legs 52, thus raising the rear of treadmill 10 relative to front legs 52, causing an incline in the entire base 12. In the first belt platform 34 lift, belt motor 40 is supported within belt platform 34. Incline motor 42 is connected to belt platform 34, such as by supports 56. Actuation of incline motor 42 causes the lifting of belt platform 34, including belt motor 40 and the accompanying drive mechanics. In the second belt platform 34 lift, belt motor 40 is not supported within belt platform 34, but is supported within support platform 32. Incline motor 42 is connected to belt platform 34 or axle 48, such as by supports 58. Actuation of incline motor 42 causes the lifting of belt platform 34, with belt motor 40 and the accompanying drive mechanics remaining below in support platform 32. The degree of inclination chosen by user U is adjustable from controls on hand controller 16. With this arrangement, it is therefore possible to vary the inclination of belt 20 during the exercise regimen. This configuration is known in the treadmill art.

FIG. 4 also schematically illustrates an example weight resistance means 46 for the treadmill 10. Weight resistance means 46 is operatively connected to pivot arm 14 via cable 18. Cable 18 can be directed around one or more pulleys 60 to prevent cable 18 from becoming entangled in the internal mechanical components of treadmill 10. Specifically, cable 18 is attached to lower pivot arm 14B, travels around pulley or pulleys 60 if necessary, and attaches to weight resistance means 46. In operation, when user U grips hand controller 16 and starts belt 20 moving, user U begins to walk or run in a simulated backwards direction relative to hand controller 16, causing user U to pull on hand controller 16. This pulling transfers to pivot arm 14, as hand controller 16 is attached to pivot arm 14, thus pulling on cable 18, which in turn pulls on weight resistance means 46.

The degree of weight resistance can be controlled by user U. In the lowest setting, it can be possible for user U to pull pivot arm 14 all the way to a stop (not shown) preventing pivot arm from moving any farther. At such a setting, user U would be simulating dragging or pulling little or no weight and the exercise regimen would be similar to walking or running backwards, and pivot arm 14 would provide user U with stability. In other settings, weight resistance means 46 can be set high enough to prevent user U from pulling pivot arm 14 all the way to the stop (not shown). At such settings, user U would be simulating dragging or pulling a weight and the exercise regimen would be similar to walking or running backwards while dragging or pulling an object of a weight comparable to the setting of the weight resistance means 46. The higher the setting of the weight resistance means 46, the heavier the simulated object being pulled. The degree of weight resistance chosen by user U is adjustable from controls on hand controller 16. With this arrangement, it is therefore possible to vary the weight resistance being dragged or pulled during the exercise regimen.

In preferred embodiments, weight resistance means 46 can be an adjustable spring or hydraulic cylinder, a spring with a known spring constant or a hydraulic or pneumatic cylinder with a known resistance, a flexible rod with a known elastic modulus, or a frictional coupling with known coefficients of friction. Each of these elements is known in the art. As discussed later, the weight resistance means 46 can be of many different forms, known or future developed, preferably so long as weight resistance simulating dragging or pulling is provided.

FIGS. 4A and 4B illustrate adjustable springs or springs with known spring constants. FIG. 4A illustrates the use of spring 70 in tension. Although adjustment mechanism 72 is shown, a spring of known spring constant can be used without adjustment mechanism 72. First end 70A of spring 70 is attached to base 12 and second end 70B of spring 70 is attached to cable 18. In tension, pulling on cable 18 in the direction of arrow P would stretch spring 70, placing it in tension. A spring of known spring constant can be used to provide a basis for determining the simulated resistance weight being dragged or pulled by user U. The use of adjustment mechanism 72 inserted at strategic positions between coils of spring 70 also can be used to adjust the simulated resistance weight.

FIG. 4B illustrates the use of spring 70 in compression. Although adjustment mechanism 72 (not shown in FIG. 4B) can be used, a spring of known or unknown spring constant can be used with adjustment mechanism 72. First end 70A of spring 70 is attached to base 12 via attachment arms 74 and second end 70B of spring 70 is attached to cable 18. In compression, pulling on cable 18 in the direction of arrow P would compress spring 70, placing it in compression. A spring of known spring constant can be used to provide a basis for determining the simulated resistance weight being dragged or pulled by user U. The use of adjustment mechanism 72 inserted at strategic positions between coils of spring 70 also can be used to adjust the simulated resistance weight.

FIGS. 4C and 4D illustrate hydraulic or pneumatic cylinders with known resistance. As hydraulic and pneumatic cylinders operate on the same general principle, FIGS. 4C and 4D will be discussed in connection with hydraulic cylinders; however, the same discussion applies to pneumatic cylinders. FIG. 4C illustrates the use of hydraulic cylinder 76 in pulling configuration. Hydraulic cylinder 76 is attached to base 12 and piston rod 78 is attached to cable 18. Pulling on cable 18 in the direction of arrow P pulls piston rod 78 out of hydraulic cylinder 76, with the fluid within hydraulic cylinder 76 providing resistance. The use of a hydraulic cylinder with known or adjustable resistance, in which the resistance is created by pulling piston rod 78 out of hydraulic cylinder 76, can be used to provide a basis for determining the simulated resistance weight being dragged or pulled by user U.

FIG. 4D illustrates the use of hydraulic cylinder 76 in pushing configuration. Hydraulic cylinder 76 is attached to base 12 via attachment arms 74 and piston rod 78 is attached to cable 18 via attachment arms 74. Pulling on cable 18 in the direction of arrow P pushes piston rod 78 into hydraulic cylinder 76, with the fluid within hydraulic cylinder 76 providing resistance. The use of a hydraulic cylinder with known or adjustable resistance, in which the resistance is created by pushing piston rod 78 into hydraulic cylinder 76, can be used to provide a basis for determining the simulated resistance weight being dragged or pulled by user U.

FIG. 4E illustrates the use of flexible rod 80. At least one end of rod 80 is attached to base 12 and a middle section or another end of rod 80 is attached to cable 18. Pulling on cable 18 in the direction of arrow P would flex rod 80, producing a combination of compression forces and tension forces in rod 80. A flexible rod or rods of known elastic modulus can be used to provide a basis for determining the simulated resistance weight being dragged or pulled by user U.

FIG. 4F illustrates the use of friction members 82, 84 in pulling configuration. First friction member 82 is attached to base 12 and second friction member 84 is attached to cable 18. Pulling on cable 18 in the direction of arrow P pulls second friction member 84 against first friction member 82, providing frictional resistance. The use of friction members with known or adjustable coefficients of friction, in which the frictional resistance is created by pulling second friction member 84 against first friction member 82, can be used to provide a basis for determining the simulated resistance weight being dragged or pulled by user U.

Other weight resistance means 46 include electromagnetic braking, eddy current mechanisms, weight stacks, resistance bands, spring-powered reels, pneumatic, air resistance, and water paddles. Each of these other weight resistance means 46 are known and can be adapted for this invention without undue experimentation. Further, other weight resistance means are suitable for use in this invention, including known and future developed weight resistance means.

A comparison of the position of pivot arm 14 in FIG. 1 versus FIG. 4 shows how pivot arm 14 can move. Pivot arm 14 is shown in the at rest position in FIG. 4, and in the operational position in FIG. 1 and in the ghost lines in FIG. 4. Pivot arm 14 can pivot between the at rest position and a fully extended position, and the position of pivot arm 14 during operation is dependent on user U. Stops (not shown) prevent pivot arm 14 from moving past the at rest position in one direction of motion and the fully extended position in the opposite direction of motion. Further, a comparison of the position of belt 20 in FIGS. 1, 3 and 4 versus FIG. 2 shows how belt 20 can incline. Belt 20 is shown in the level position in FIGS. 1, 3 and 4 and in the inclined position in FIG. 2 and the ghost lines of FIG. 4. Belt 20 (specifically belt platform 34 or base 12) can incline between the level position and the fully inclined position, and the inclination of belt 20 is dependent on user U.

FIG. 5 is a top view of the base of the invention illustrating the relative positioning of various components of treadmill 10. Front step offs 24 run across at least a portion of the front of base 12 on either side of pivot arm 14. Side step offs 22 run at least a portion of the length of base 12 from front to rear of treadmill 10. Rear step offs 26 are not shown in this embodiment. Step off surfaces 22, 24, 26 provide a surface upon which user U can step onto before, during or after belt 20 begins to move. Slot 86 is where cable 18 enters base 12. Hole 88 is where pivot arm 14 enters base 12. Pivot arm 14 is pivotally attached within base 12 via a known type of connection (not shown).

FIG. 6 is a top view of a representative hand controller 16 for the invention showing various features that can be included on the hand controller 16. FIG. 7 is a side view of the representative hand controller 16 for the invention shown in FIG. 6. A number of visual displays can be included on hand controller 16 including time display 90 that displays the elapsed time of an exercise regimen or the time remaining in a count down for an exercise regimen, heart rate display 92 that shows the heart rate of user U assuming a heart rate monitor is being used and treadmill 10 include the features of heart rate monitoring, incline display 94 representing the incline of belt 20 in degrees or other units, load display 96 representing the load or weight being dragged or pulled, and speed display 98 representing how fast user is moving. Such displays are known in the treadmill art.

Additional displays can include a mile display to display the simulated distance traveled by user U during the exercise regimen, a calorie display to display the current rate of user U calorie expenditure or the total calories expended by user U during the exercise regimen. Further, hand controller 16 can include an input key pad with which user U can communicate with a microprocessor that operates treadmill 10 so as to operate treadmill 10 as well as set the parameters for exercise regimens. Also included on hand controller is or can be on-off buttons, emergency stop button 100, increase buttons 102 to increase a parameter, decrease buttons 104 to decrease parameters, and other functional input devices. All of these are known in the treadmill art. Further, hand grips 106 also can comprise input means (not shown) for reading user's U heart rate, as is known in the art.

Treadmill 10 utilizes a known microprocessor (not shown) to control and operate the various features of the invention. For example, the speed of belt motor 40, and hence the speed of belt 20, is controlled by the microprocessor. Further, the inclination of belt 20 also is controlled by the microprocessor. Additionally connected to the microprocessor are the various display and other elements 90, 92, 94, 96, 98, 100,102,104 (and others, if present) of the hand controller 16. For the sake of simplicity, the signals are transmitted to and from the microprocessor to the hand controller 16 displays 90, 92, 94, 96, 98 (and others, if present), and are operatively connected to the switches 100,102,104 (and others, if present) and the specific elements, such as belt motor 40, incline motor 42, and weight resistance means 46. Again, the use of this type of microprocessor is well known in the treadmill art.

FIG. 8 is a side view of the invention with an optional rear safety arm 108 to help prevent user U from inadvertently stepping off the rear of treadmill 10. Rear safety arm 108 can comprise pad 110 attached to upright 112, upright 112 being attached to base 12. Optionally, a second controller (not shown) can be located on rear safety arm 108 or pad 110. Such a second controller could be used to operate treadmill 10 in a more conventional manner as a forward walking treadmill. With such a configuration, user U would in effect be standing on belt 20 facing rearward towards rear safety arm 108 with the motion of belt 20 allowing forward walking and control of treadmill 10 would be accomplished via second controller.

FIG. 9 is a side view of the invention with an optional rear step-off 26 platform on which user U can step if exiting treadmill 10 from the rear. Optional side step offs 22 are the most preferable step off features, with optional front step offs 24 also being preferable due to pivot arm 14 pivoting forward in the at rest position. Rear step offs 26 are optional and provide an additional measure of safety. FIG. 9 also shows treadmill 10 in an inclined operational position using belt platform 34 and support base 32.

FIG. 10 is a side sectional view of the invention with an optional rear step-off 26 platform showing an alternate configuration of the internal mechanical components illustrating the relationship between the various major components of the device. FIG. 10 is similar to FIG. 4 in this regard, but with the shape of the rear of base 12 altered to accommodate rear step off 26.

The invention also can comprise additional optional features. For example, the invention can comprise a safety mechanism to prevent user U from speeding up the movement of belt 20 due to the weight resistance of the weight resistance means 46, and from speeding up the movement of belt 20 to a speed faster than what is shown on the hand controller 16 speed display 98. In other words, treadmill 10 can further comprise a means for preventing belt 20 from running out from under user U should either user U move too fast relative to belt 20 or belt 20 move too fast relative to user U. This also would help prevent the force of user's U foot plant from undesirably increasing the speed of belt 20. Clutches attached to belt 20 or axles 48, 50 can be used, among other known mechanisms. For another example, the step offs 22, 24, 26 optionally can be and preferably are of a substantial width to allow for a wider platform for user U to step onto or step off of treadmill 10. Side rails and kill switches also can be used. Heart rate monitors can be used, and the microprocessor can be configured to allow for heart rate monitoring and for the adjustment of belt 20 speed and incline and the level of weight resistance to maintain a desired heart rate.

In stark contrast to known treadmills, the present invention accomplishes a different exercise regimen than an aerobic walking or running workout. Initially, belt 20 travels in the opposite direction than the belt on known treadmills to provide the basis for the dragging or pulling motion. Further, the use of a weight resistance means 46 in combination with a walking or running motion in general and a backwards walking or running motion in particular provides a more complex exercise regimen. It has been found that the combination of walking or running backwards in conjunction with the simulation of dragging or pulling a load provides a useful aerobic and/or anaerobic work out and can strengthen various muscles and muscle groups, specifically leg muscles and the gluteus maximus and arm, chest and back muscles.

While the invention has been described in connection with certain preferred embodiments, it is not intended to limit the spirit or scope of the invention to the particular forms set forth, but is intended to cover such alternatives, modifications, and equivalents as may be included within the true spirit and scope of the invention as defined by the appended claims.

What is claimed is:

1. An exercise treadmill of the type having an endless moveable surface looped around rollers or pulleys to form an upper run and a lower run, the movable surface being rotated when one of the rollers or pulleys is rotated, and an exercise surface for walking or running while exercising, the improvement comprising:

a) a weight resistance means for providing a weight resistance for simulating the dragging or pulling of a load and wherein the endless movable surface moves in a direction simulating walking or running backwards;

b) a pivot arm operatively connected to the weight resistance means, wherein pivoting the pivot arm actuates the weight resistance means so as to provide weight resistance for the simulating the dragging or pulling of a load; and c) a hand controller attached to the pivot arm for operating and controlling the exercise treadmill and the weight resistance means, whereby operation of the treadmill simulates the dragging or pulling of a load by a combination of the actuation of the weight resistance means to simulate the load and the walking or running backwards to provide the dragging or pulling action.

2. The exercise treadmill as claimed in claim 1, wherein the weight resistance means can be set to a chosen weight resistance level that is variable for providing weight resistance only in the pulling direction.

3. The exercise treadmill as claimed in claim 2, wherein the weight resistance means is selected from the group consisting of springs, pneumatic cylinders, hydraulic cylinders, flexible rods, friction members, and weight stacks.

4. The exercise treadmill as claimed in claim 3, wherein the pivot arm extends generally upwards from the lower base and is attached to the lower base at a position in front of the endless movable surface.

5. The exercise treadmill as claimed in claim 4, wherein the pivot arm is pivotally attached to the lower base.

6. The exercise treadmill as claimed in claim 1, wherein the pivot arm is pivotable between a first at rest position and a second fully extended position and can be maintained at any position between the first at rest position and the second fully extended position.

7. The exercise treadmill as claimed in claim 6, wherein the weight resistance is provided by the weight resistance means at all positions of the pivot arm and only in the pulling direction of the pivot arm.

8. The exercise treadmill as claimed in claim 1, wherein the pivot arm comprises at least one pivot arm section and at least one pivot point to allow the at least one pivot arm section to pivot relative to the hand controller in a self-aligning manner, whereby as the hand controller is grasped by a user and moved in a direction relative to the user the at least one pivot arm section and the hand controller pivot allowing the hand controller to self-align to an appropriate position relative to the user.

9. An exercise treadmill comprising:

a) an endless moveable surface for walking or running, wherein the endless movable surface is movable in a direction simulating walking or running backwards;

b) a weight resistance means for simulating the dragging or pulling of a load, wherein the weight resistance means provides weight resistance only in the pulling direction;

c) a pivot arm operatively connected to the weight resistance means, wherein pivoting the pivot arm actuates the weight resistance means so as to provide weight resistance for the simulating the dragging or pulling of a load; and d) a hand controller attached to the pivot arm for operating and controlling the exercise treadmill and the weight resistance means, whereby operation of the treadmill simulates the dragging or pulling of a load by a combination of the actuation of the weight resistance means to simulate the load and the walking or running backwards to provide the dragging or pulling action.

10. The exercise treadmill as claimed in claim 9, wherein the weight resistance means is selected from the group consisting of springs, pneumatic cylinders, hydraulic cylinders, flexible rods, friction members, and weight stacks.

11. The exercise treadmill as claimed in claim 9, wherein the weight resistance means can be set to a chosen weight resistance level.

12. The exercise treadmill as claimed in claim 11, wherein the weight resistance means can be set to a chosen weight resistance level that is variable for providing weight resistance.

13. The exercise treadmill as claimed in claim 9, wherein the pivot arm comprises at least two pivot arm sections, the pivot arm is pivotally connected to the lower base at a position in front of the endless movable surface, the at least two pivot arm sections are pivotally connected to each other via a first mounting means, and one of the at least two pivot arms is connected to the hand controller via a second mounting means.

14. The exercise treadmill as claimed in claim 13, further comprising an inclination mechanism to permit inclination of the exercise surface to simulate an incline or decline.

15. The exercise treadmill as claimed in claim 13, wherein the pivot arm is pivotable between a first at rest position and a second fully extended position and can be maintained at any position between the first at rest position and the second fully extended position.

16. The exercise treadmill as claimed in claim 9, further comprising at least one step off platform attached to or a part of the lower base to provide a surface that can be stepped onto before, during or after use of the treadmill.

17. The exercise treadmill as claimed in claim 9, further comprising a rear safety arm attached to and extending generally upwards from the lower base at a position in back of the endless movable surface opposite the endless movable surface from the pivot arm.

18. The exercise treadmill as claimed in claim 17, further comprising second controller located on the rear safety arm, wherein the second controller can be used to operate the exercise treadmill in a more conventional manner as a forward walking treadmill.

19. The exercise treadmill as claimed in claim 15, wherein the weight resistance is provided by the weight resistance means at all positions of the pivot arm.

20. The exercise treadmill as claimed in claim 9, wherein the pivot arm comprises at least one pivot arm section and at least one pivot point to allow the at least one pivot arm section to pivot relative to the hand controller in a self-aligning manner, whereby as the hand controller is grasped by a user and moved in a direction relative to the user the at least one pivot arm section and the hand controller pivot allowing the hand controller to self-align to an appropriate position relative to the user.

21. An exercise method simulating the pulling or dragging of a load, comprising the steps of:

a) stepping onto an endless looped belt that is looped around rollers or pulleys to form an upper run and a lower run so as to form a movable surface with the upper run comprising an exercise surface;

b) grasping a hand controller operationally connected to a weight resistance means via a pivot arm and adjusting the weight resistance means via the hand controller to a chosen weight resistance level, wherein pivoting the pivot arm by pulling on the hand controller actuates the weight resistance means so as to provide weight resistance only in the pulling direction for the simulating the dragging or pulling of a load;

c) walking or running in a rearwards motion on the upper run while pulling on the hand controller, whereby the walking or running in a rearwards motion causes the actuation of the weight resistance means, thus simulating the pulling or dragging of a load by a combination of the actuation of the weight resistance means to simulate the load and the walking or running backwards to provide the dragging or pulling action.

22. The exercise method as claimed in claim 21, further comprising the step of adjusting the speed of the endless looped belt.

23. The exercise method as claimed in claim 21, further comprising the step of adjusting the inclination of the endless looped belt.

24. The exercise method as claimed in claim 21, wherein the pivot arm comprises at least one pivot arm section and at least one pivot point to allow the at least one pivot arm section to pivot relative to the hand controller in a self-aligning manner, and wherein when grasping the hand controller and moving the hand controller in a direction relative to the user the at least one pivot arm section and the hand controller pivot allowing the hand controller to self-align to an appropriate position relative to the user.

* * * * *